US006530104B2

(12) United States Patent
Taylor

(10) Patent No.: US 6,530,104 B2
(45) Date of Patent: Mar. 11, 2003

(54) POT SCRUBBER

(76) Inventor: Jerome T. Taylor, 851 Eight Mile La., Greenville, KY (US) 42345

( * ) Notice: Subject to any disclaimer, the term of this patent is extended or adjusted under 35 U.S.C. 154(b) by 0 days.

(21) Appl. No.: 09/781,904

(22) Filed: Feb. 8, 2001

(65) Prior Publication Data

US 2001/0032369 A1 Oct. 25, 2001

Related U.S. Application Data

(60) Provisional application No. 60/181,343, filed on Feb. 9, 2000.

(51) Int. Cl.[7] ..... A47L 15/00; A47L 15/37

(52) U.S. Cl. ..... 15/101; 15/56; 15/76

(58) Field of Search ..... 15/56, 57, 58, 15/59, 65, 67, 70, 71, 73, 74, 75, 76, 101

(56) References Cited

U.S. PATENT DOCUMENTS

| | | | | |
|---|---|---|---|---|
| 2,242,361 | A | * | 5/1941 | Lewis |
| 2,639,451 | A | * | 5/1953 | Ford |
| 2,869,794 | A | * | 1/1959 | Modrey |
| 3,204,273 | A | * | 9/1965 | Gallo |
| 3,413,672 | A | * | 12/1968 | Gallo |
| 3,663,979 | A | * | 5/1972 | Shaw |
| 5,619,767 | A | * | 4/1997 | Larson |

* cited by examiner

*Primary Examiner*—Terrence R. Till
(74) *Attorney, Agent, or Firm*—Gary K. Price, Esq.

(57) ABSTRACT

The invention is an apparatus suitable for cleaning pots comprising a drive, a shaft assembly, and at least one (1) pad attached to the shaft assembly. The drive rotates the shaft assembly which rotates the at least one (1) pad which is capable of scouring a pot surface held against the rotating pad.

4 Claims, 8 Drawing Sheets

POT SCRUBBER

CROSS REFERENCES TO RELATED APPLICATIONS

Provisional Application for Patent, application No. 60/181,343, filed Feb. 9, 2000, with the same title, "Pot Scrubber" which is hereby incorporated by reference. Applicant claims priority pursuant to 35 U.S.C. 119(e)(i).

BACKGROUND OF THE INVENTION

Statement as to rights to inventions made under federally sponsored research and development:

Not Applicable.

1. Field of Invention.

This invention relates to an apparatus useful for, but not restricted to, the scrubbing of pots such as would be used by cooks in preparing meals.

2. Background Information.

Cleaning pots and pans is a low technology manual operation, little changed over the years, normally done by unskilled labor or perhaps apprentice chefs. Such labor can be unreliable at times, especially in prosperous times so skilled chefs find themselves, by default, scouring pots and pans. In the interest of kitchen efficiency, a better way is required.

As will be seen from the subsequent description, the preferred embodiments of the present invention overcome shortcomings of existing prior art pot cleaning technology.

SUMMARY OF THE INVENTION

The present invention is an apparatus useful for, but not restricted to, cleaning kitchen items such as pots, and pans, comprising a drive means driving a shaft assembly rotating at least one (1) pad, said at least one (1) pad cleaning a pot surface when said pot is held against the pad. The drive means comprising an electric motor and a right angle gear box, in the preferred embodiment of the present invention. The electrical controls include a normally open spring return switch that an operator can lean against, or otherwise actuate, to activate the electric motor to rotate the at least one (1) pad as required. Backing away from said switch results in cessation of pad rotation.

DESCRIPTION OF THE PREFERRED EMBODIMENTS

Figure 1:
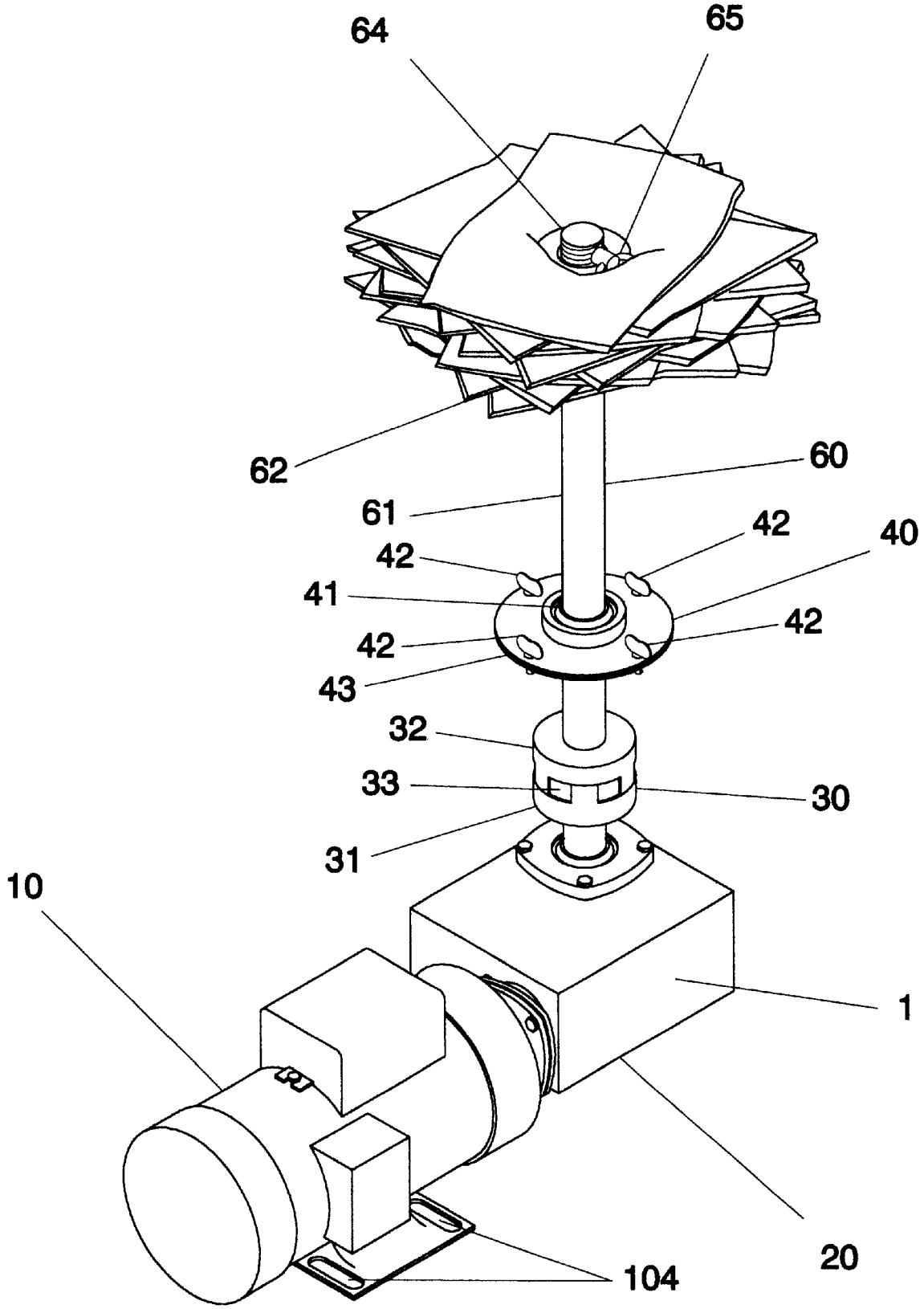
FIG. 1 illustrates a preferred embodiment of the present invention, a pot scrubber.
Figure 10:
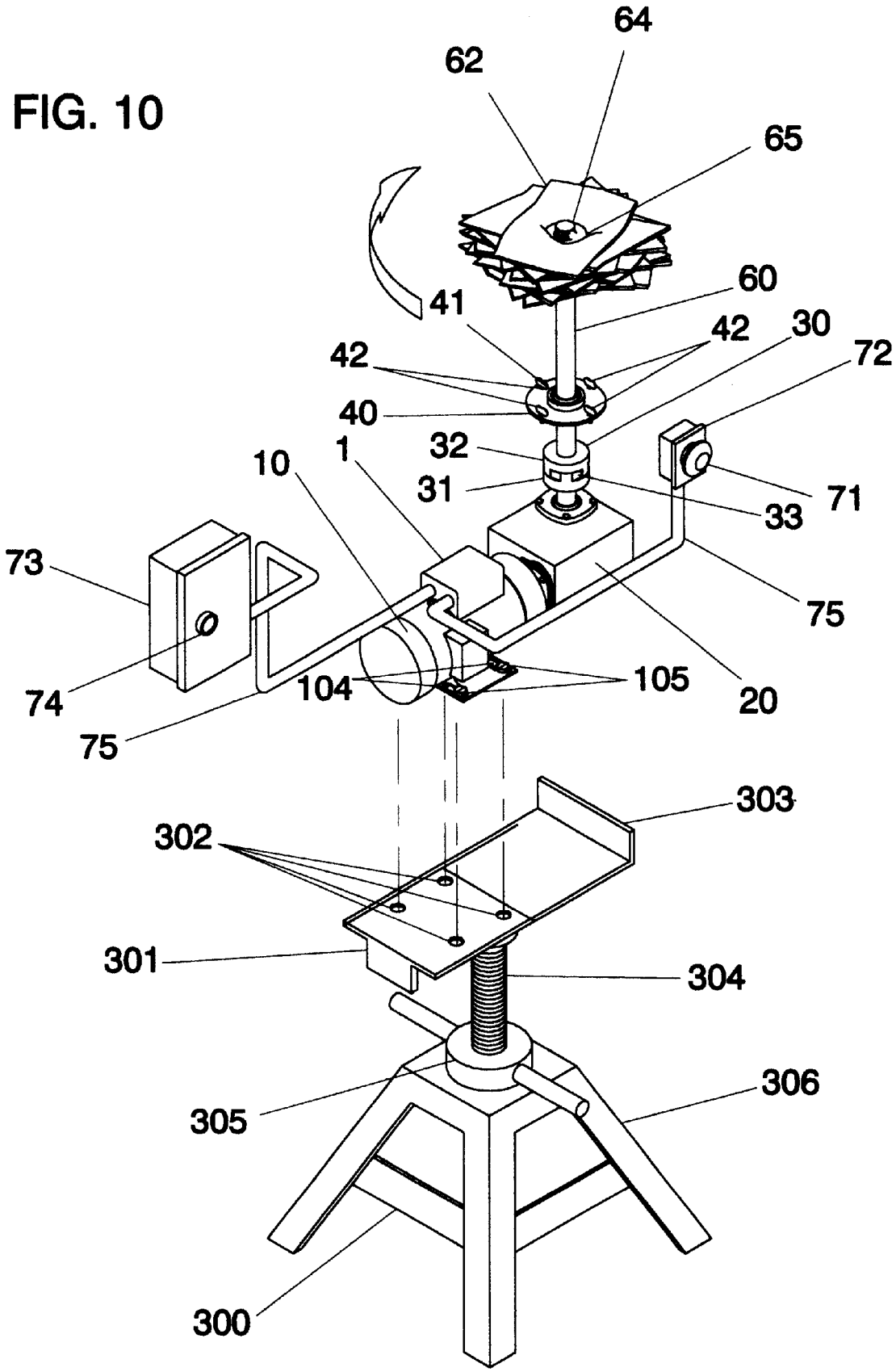
FIG. 10 illustrates a means of height adjustment of the preferred embodiment of the present invention.

Shown in FIG. 1 is a preferred embodiment of the present invention, a pot scrubber 1 comprising a drive means comprising a motor 10 in conjunction with a gearbox 20. In the preferred embodiment of the present invention, the motor 10 is a 220 volt 3 phase electric motor, although, as obvious to anyone skilled in the art, other types of motors could be used including electric motors of different voltage or even hydraulic driven motors. The gearbox 20, in the preferred embodiment of the present invention is a right angle worm gearbox, although, as obvious to anyone skilled in the art, other types of gearboxes would serve the same purpose. The pot scrubber 1 further comprises a shaft assembly 60 which is driven by the above said drive means comprising the motor 10 in conjunction with the gearbox 20. The shaft assembly 60 drives the at least one (1) cleaning pad 62 in a rotating motion (Ref. FIG. 10). A pot surface can be cleaned by holding said pot surface against the at least one (1) cleaning pad 62 while the cleaning pad 62 is rotated.

Figure 2:
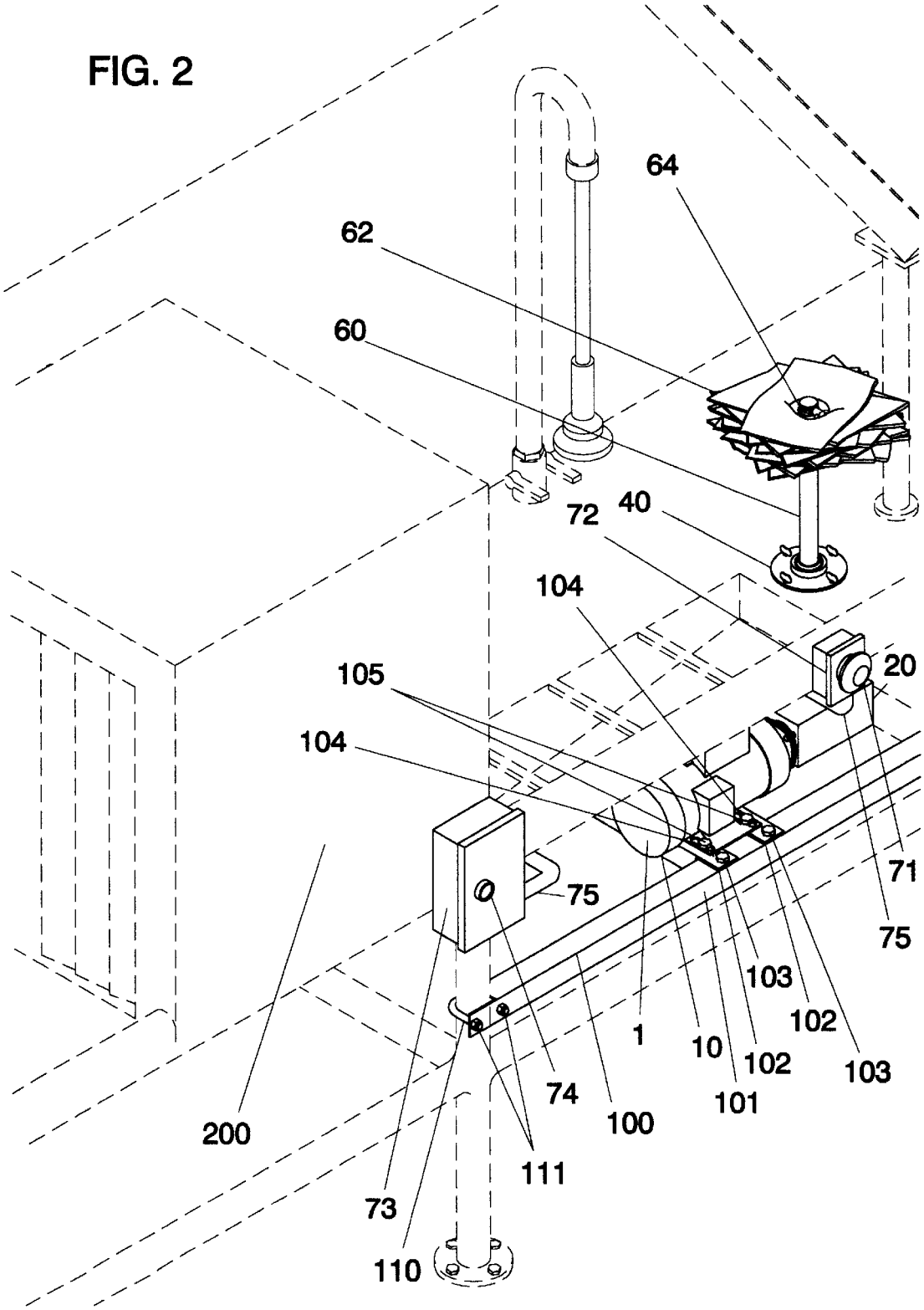
FIGS. 2 and 3 illustrate an installation of the preferred embodiment of the present invention.

As shown in FIGS. 1, 5, 6, 7, 8 and 9, the shaft assembly 60 comprises a shaft 61, a seal housing assembly 40, and a coupling assembly 30, a top washer 64, nut 68, a spring detent pin 65, a key 34, a snap ring 66, and a bottom washer 67. The shaft 61 comprises threads 61A, a pin clearance 61B, a keyway 61C, and a snap ring groove 61D. The seal housing assembly 40 comprises quarter turn fasteners 42, a seal 41, and a gasket 43. The seal 41 in the preferred embodiment of the present invention is a spring loaded lip seal in a metal case that can be press fitted into the seal housing assembly 40. FIG. 2 shows the shaft assembly 60 mounted and extending upwardly through a prior art mounting surface 200 by means of the seal housing assembly 40. The quarter turn fasteners 42 serve to fasten the seal housing assembly 40 to the prior art mounting surface 200 which in turn positions the shaft assembly 60 in place. The bottom washer 67 which is held in position with respect to the shaft 61 by means of the snap ring 66 engaged into the snap ring groove 61D will be underneath the prior art mounting surface 200. The seal housing assembly 40 mounts on top of the prior art mounting surface 200. The coupling assembly 30 comprises a top half 32 and bottom half 31 and inserts 33. The top half 32 comprises a shaft clearance 33A and a coupler keyway 33B (shown in FIG. 5). The key 34 secures the top half 32 to the shaft 61. Coupling assemblies such as the coupling assembly 30 are common to the trade and supplied by a number of firms, under a variety of tradenames, including LOVEJOY couplings. The at least one (1) pad 62 include, in the preferred embodiment of the present invention, a clearance 62A. The nuts 68, when installed on the shaft 61, support the pads 62. The pad 62 is retained on the shaft 61, in the preferred embodiment of the present invention, by the top washer 64 which is secured in position by the spring detent pin 65. The spring detent pin 65 facilitates replacement of the pad 62 as required. The nuts 68 are tightened sufficiently against the pad 62 held in position by the top washer 64 secured in position by said pin 65 so that the pad 62 is sufficiently fluffed so that a pot surface against the top of the pad 62 does not come in contact with the shaft 61, which would tend to scar said pot surface. The at least one (1) pad 62 is known in the trade and supplied by a number of firms.

Figure 3:
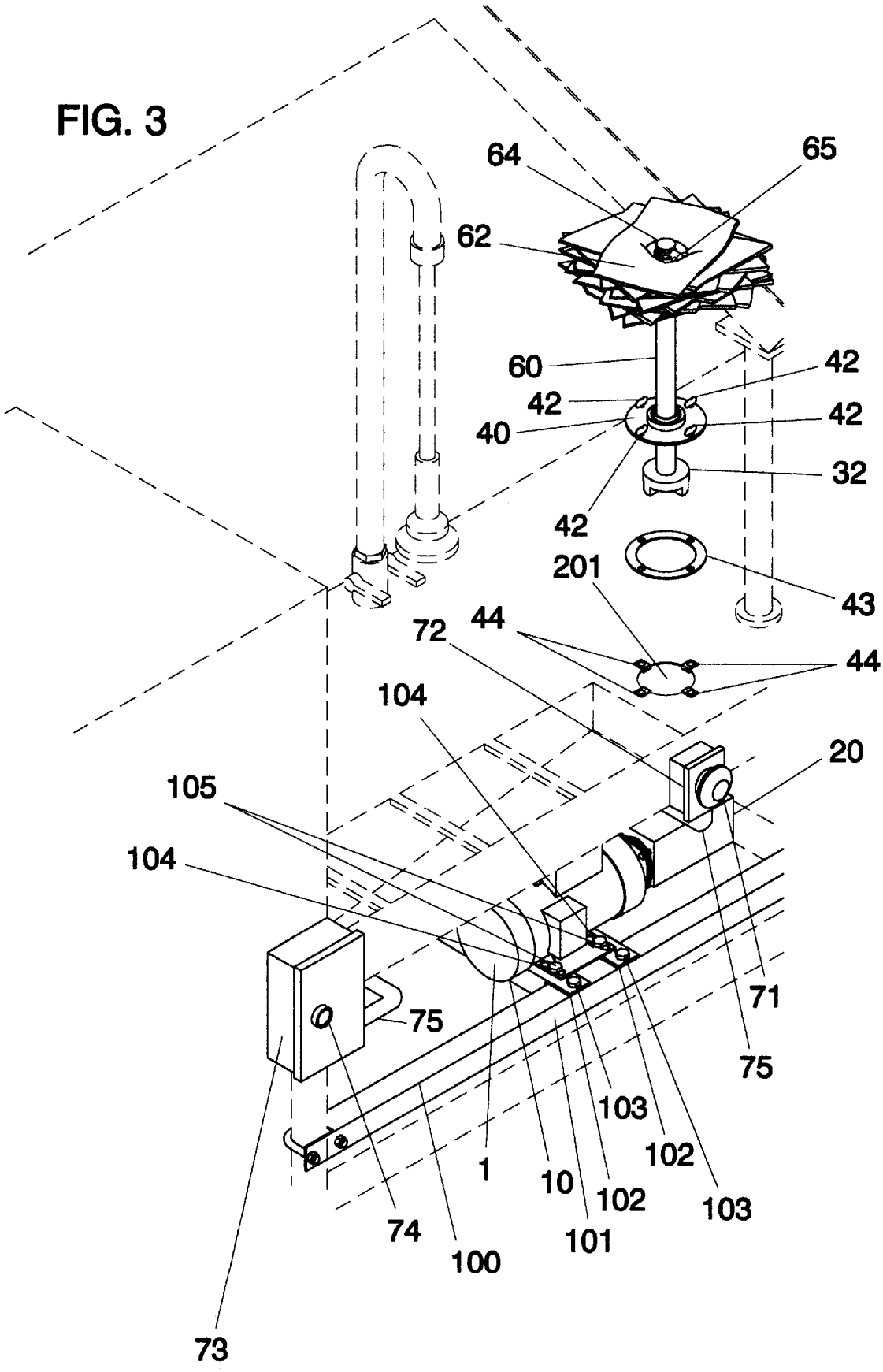
Figure 4:
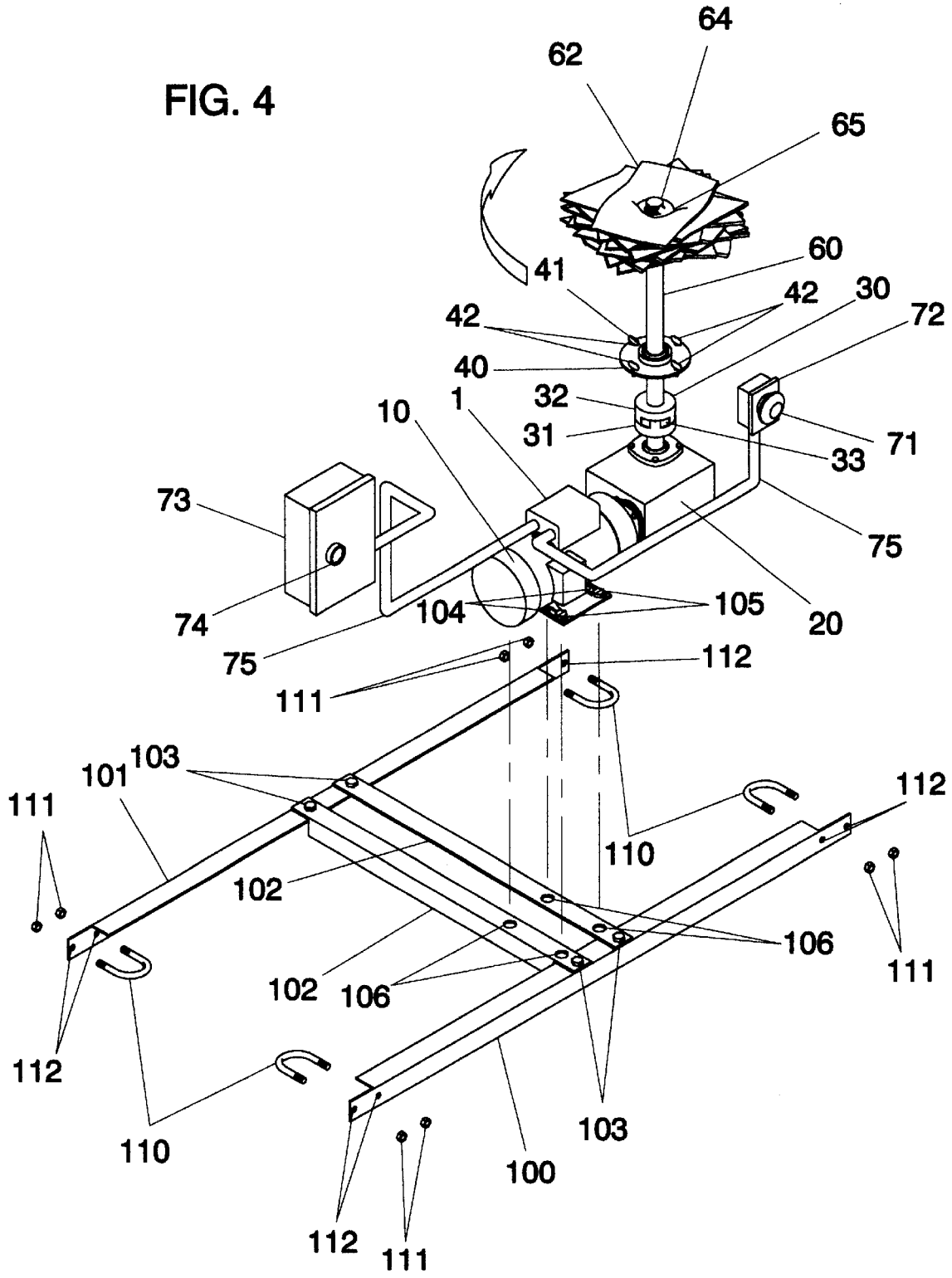
FIG. 4 illustrates details of the installation of the preferred embodiment of the present invention.
Figure 5:
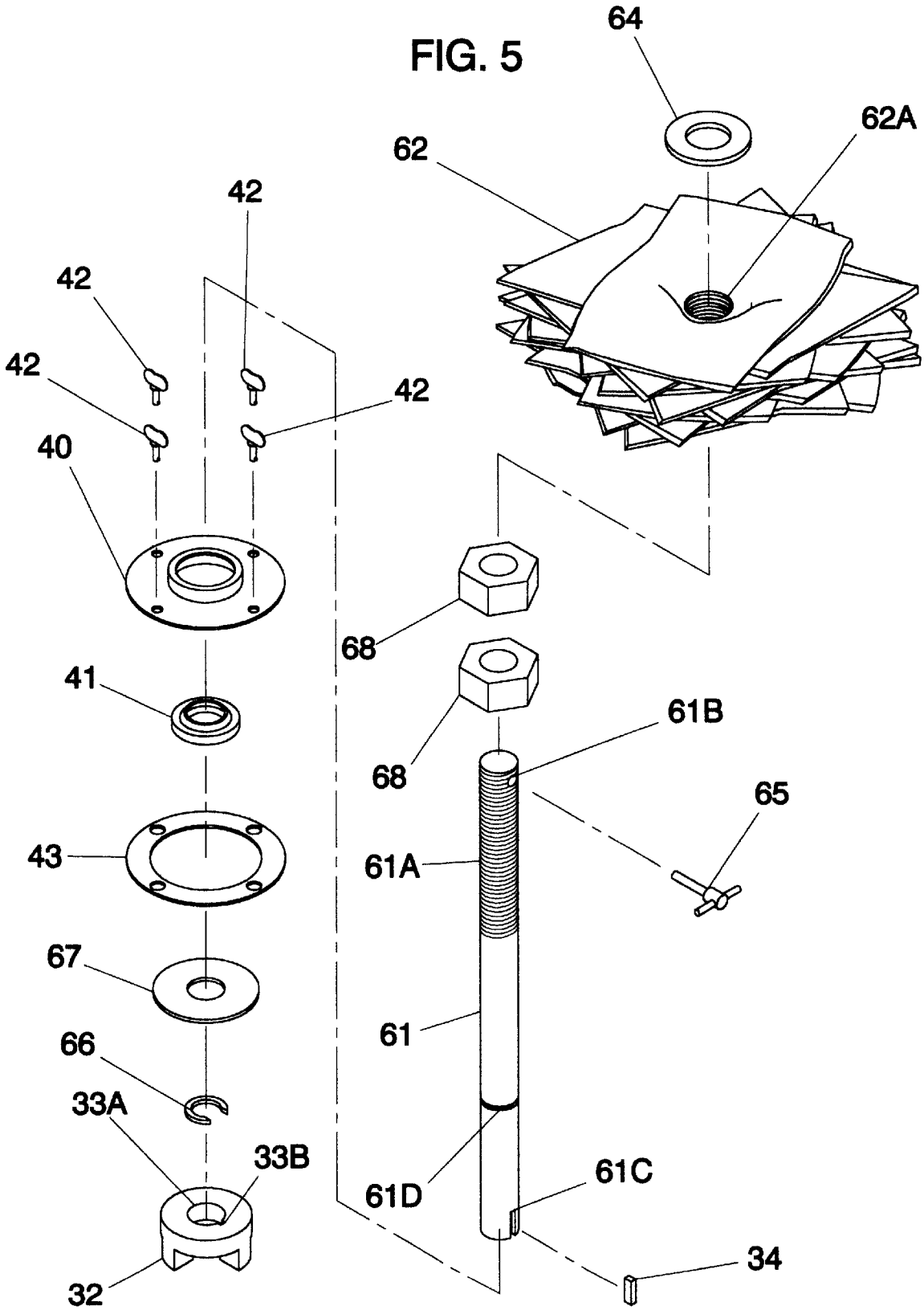
FIG. 5, illustrates the shaft assembly, seal housing assembly, and at least one (1) cleaning pad of the present invention.
Figure 6:
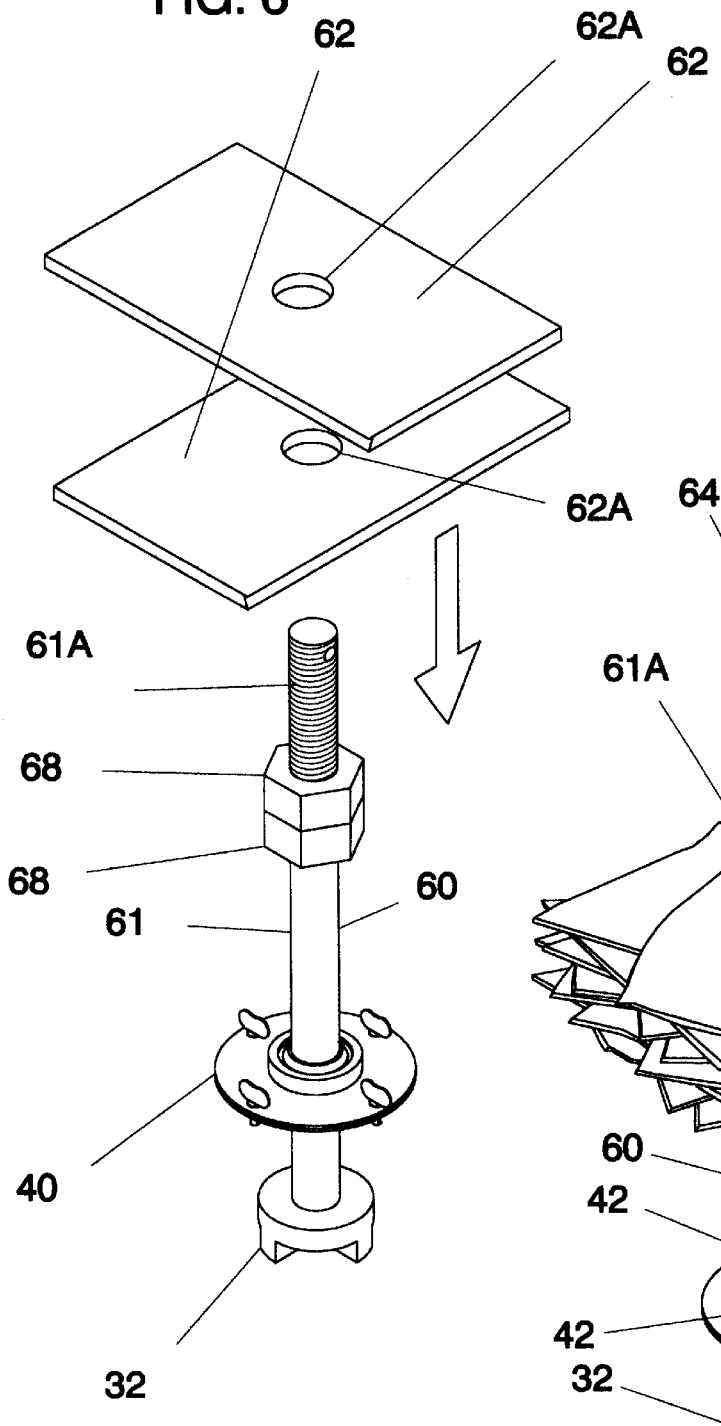
FIGS. 6, 7, and 8, illustrate installation of the at least one (1) cleaning pad on the shaft assembly.
Figure 7:
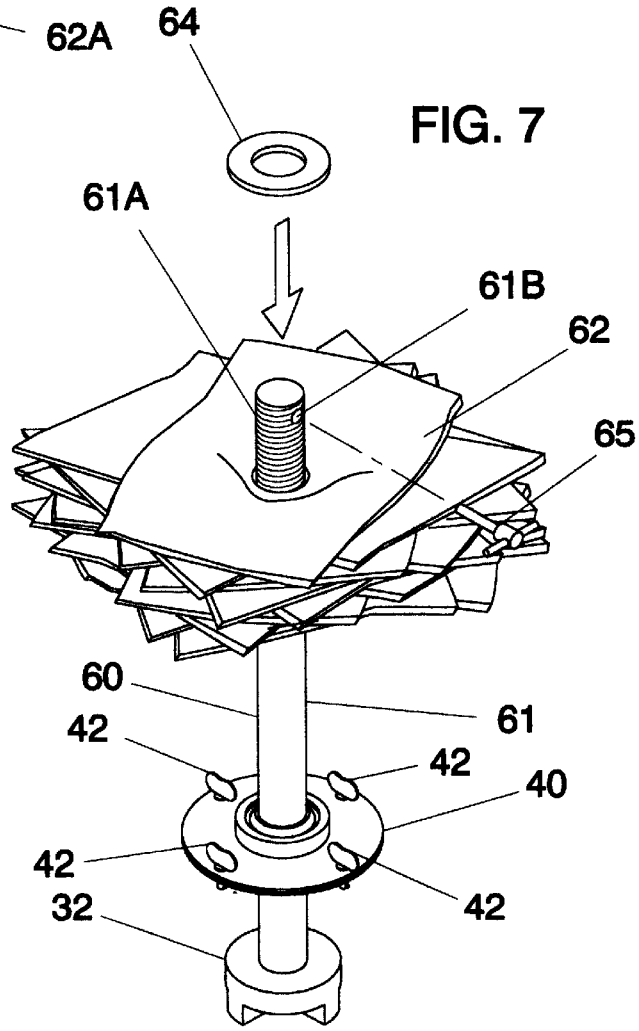
Figure 8:
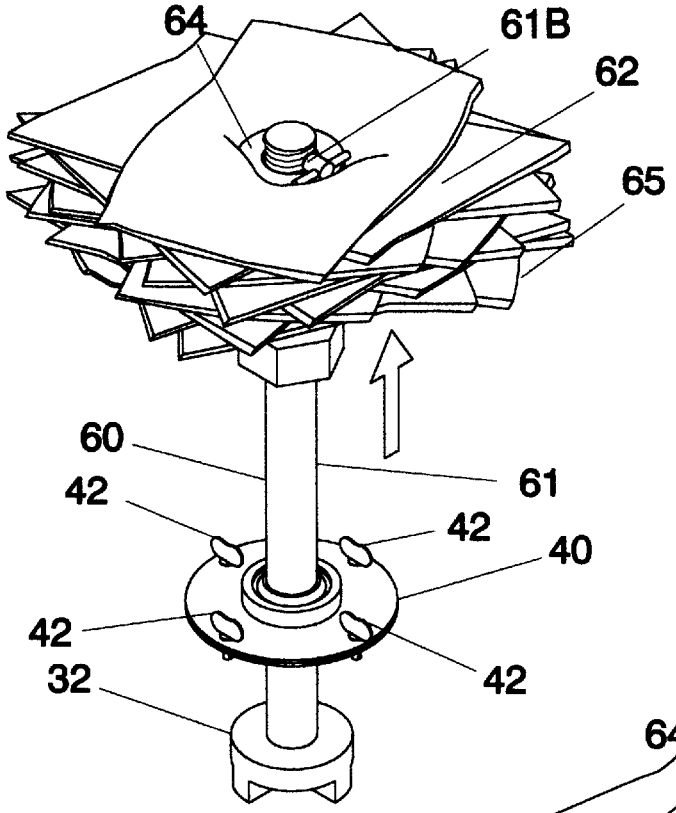
Figure 9:
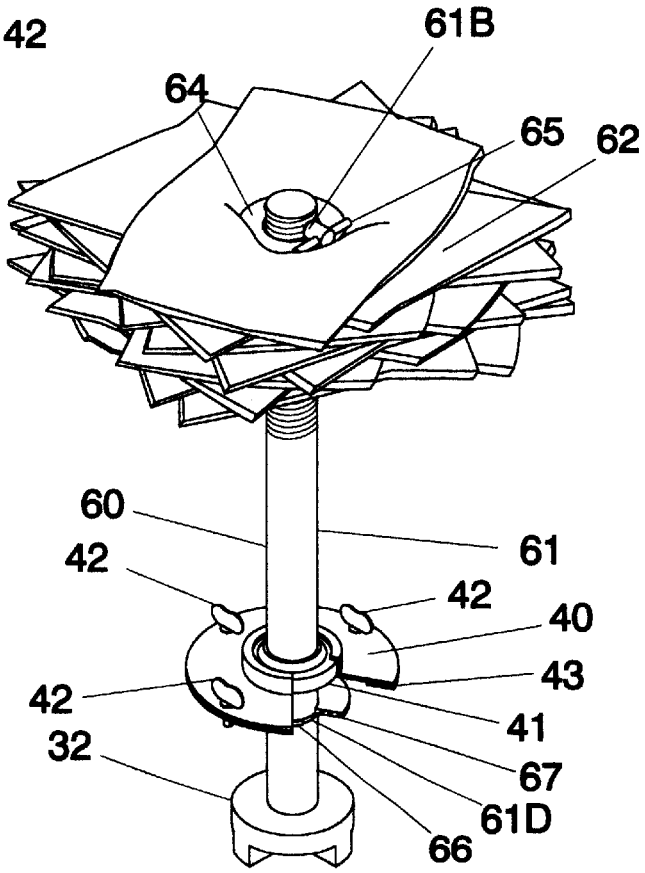
FIG. 9, illustrates installation of the seal housing assembly on the shaft of the shaft assembly.

FIGS. 2, 3, and 4 illustrate the pot scrubber 1 in a typical installation with an electrical enclosure 73 with a master power switch 74, an electrical conduit 75, a switch enclosure 72, and a normally open spring return pushbutton switch 71. In operation, a person using the pot scrubber 1 can lean against said switch 71 to activate the pot scrubber 1 as required, causing the shaft 61 and therefor the at least one (1)

pad 62 to rotate. Backing away from said switch 71 would result in the shaft 61 and the pad 62 ceasing to rotate. Also shown is a mounting frame assembly 100 comprising main struts 101, motor mount struts 102, bolts 103, U-bolts 110, and U-bolt nuts 111. The main struts 101 include U-bolt clearances 112. The motor mount struts 102 comprises mount bolt clearances 106 for motor mounting bolts 105 through motor mount bolt clearances 104.

FIG. 10 illustrates an alternate mounting installation for the pot scrubber 1. In FIG. 10, the pot scrubber 1 is mounted to an adjustable height mount assembly 300 comprising an alternate mounting plate 301 with mount bolt apertures 302, a gearbox support 303, a threaded shaft 304, an adjusting collar 305, and a base 306. Said plate 301 is affixed to said shaft 304 which sits in said base 306, said shaft 304 being supported in base 306 by said collar 305. Said collar 305 mates with said shaft 304 so the height of said assembly 300 can be adjusted by rotating said collar 305 with respect to said shaft 304. The center of gravity of the motor 10 and the gearbox 20, in the preferred embodiment of the present invention, sufficiently coincides with said shaft 304 so that, in conjunction with the seal housing assembly 40 attaching to the prior art mounting surface 200 (Ref. FIG. 3) by means of the quarter turn fasteners 42, as previously discussed, the installation of the pot scrubber 1 with said mount assembly 300 is sufficiently stable to serve the intended purpose of scrubbing pots.

The materials of construction of the present invention are metal except for the at least one (1) pad 62, inserts 33, the gasket 43, and said seal 41. The preferred metal is stainless steel, although, as obvious to anyone skilled in the art, other metals would serve, albeit perhaps not as well. As water and soap will be used in conjunction with this invention as required, corrosion is a design consideration in the selection of materials.

Although the description above contains many specificities, these should not be construed as limiting the scope of the invention but as merely providing illustrations of some of the presently preferred embodiments of this invention.

For example, the quarter turn fasteners 42 are given as the preferred embodiment of the present invention for attachment of the seal housing assembly 40 to the prior art mounting surface 200, primarily for case of seal 41 replacement. As obvious to anyone skilled in the art of mechanical installations, there are a number of ways to accomplish the attachment of a seal housing assembly 40 to a mounting surface 200. Beyond that, one could accomplish the location of the shaft assembly 60 by other means to the seal housing assembly 40, such means could be a collar with no seal and perhaps a busing. Or a seal could be used that is not a spring loaded lip seal. These alternatives might work, albeit not as well as the preferred embodiments discussed.

Thus the scope of the invention should be determined by the appended claims in the formal application and their legal equivalents, rather than by the examples given.

I claim:

1. An apparatus useful for scrubbing pots comprising:

a drive means, a shaft assembly driven by the drive means, at least one (1) pad driven by the shaft assembly, and a normally open spring pushbutton switch that is used to actuate said apparatus as required for scrubbing said pots, wherein said at least one (1) pad when driven by said shaft assembly provides a cleaning action as required against a surface held against said pad, wherein the shaft assembly further comprises a seal housing assembly comprising of fasteners, and a seal, wherein said shaft assembly is mounted through a mounting surface by means of said seal housing assembly, the fasteners serving to fasten the shaft housing assembly to said mounting surface which in turn positions the shaft assembly in place.

2. An apparatus useful for scrubbing pots comprising:

a drive means, a shaft assembly driven by the drive means, at least one (1) pad driven by the shaft assembly, an adjustable height mount assembly, and a normally open spring pushbutton switch that is used to actuate said apparatus as required for scrubbing said pots, wherein said at least one (1) pad when driven by said shaft assembly provides a cleaning action as required against a surface held against said pad.

3. The apparatus of claim 2 wherein the adjustable height mount assembly comprises:

a. a mounting plate, b. a threaded shaft, c. an adjusting collar, and d. abase, wherein said mounting plate is affixed to the threaded shaft, wherein said shaft sits in said base, said shaft being supported in said base by said collar, said collar meting with said shaft so the height of said mount assembly can be adjusted by rotating said collar with respect to said shaft.

4. An apparatus useful for scrubbing pots, which is a pot scrubber, comprising a drive means, a shaft assembly which is driven by said drive means, at least one (1) cleaning pad, and a normally open spring pushbutton switch that is used to actuate the pot scrubber as required for scrubbing pots, said drive means comprising a motor and a gear box, said shaft assembly comprising a shaft, and a seal housing assembly, wherein the shaft assembly drives the at least one (1) pad in a rotating motion thereby causing a cleaning action as required against a surface held against the pad, said shaft of the shaft assembly is mounted upwardly extending through a mounting surface by means of the seal housing assembly so that the at least one (1) pad is positioned above the mounting surface.

* * * * *